US009815583B2

(12) United States Patent
Shpakow

(10) Patent No.: US 9,815,583 B2
(45) Date of Patent: Nov. 14, 2017

(54) CONTAINER THROAT DISPENSING ADAPTER AND METHOD

(71) Applicant: Lisle Corporation, Clarinda, IA (US)

(72) Inventor: Thomas Shpakow, Littleton, CO (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 14/707,836

(22) Filed: May 8, 2015

(65) Prior Publication Data

US 2015/0321802 A1 Nov. 12, 2015

Related U.S. Application Data

(60) Provisional application No. 61/990,599, filed on May 8, 2014.

(51) Int. Cl.

| | |
|---|---|
| ***B65D 37/00*** | (2006.01) |
| ***B65D 1/32*** | (2006.01) |
| ***B65D 47/06*** | (2006.01) |
| ***B65D 39/00*** | (2006.01) |
| ***B65D 35/44*** | (2006.01) |

(52) U.S. Cl.

CPC ..... *B65D 1/323* (2013.01); *B65D 35/44* (2013.01); *B65D 39/0029* (2013.01); *B65D 47/06* (2013.01)

(58) Field of Classification Search

CPC .... B65D 1/323; B65D 35/44; B65D 39/0029; B65D 47/06; B65D 39/12; B65D 39/0023; B65D 39/0011; B65D 39/0005; B65D 39/00; B65D 39/008; B65D 2251/08; B65D 2543/00546; F16L 25/14; A47K 5/1205; A47K 2005/1218

USPC ..... 222/211; 215/307, 309

See application file for complete search history.

(56) References Cited

U.S. PATENT DOCUMENTS 650,615 A * 5/1900 Salomon ..... B65D 51/1688 137/512.2
1,577,539 A * 3/1926 Polk ..... G01F 11/084 215/309
2,802,587 A * 8/1957 Parvin ..... B65D 47/06 215/307
3,241,726 A * 3/1966 Chester ..... B65D 47/2031 222/211
3,282,457 A * 11/1966 Sirois ..... B01L 3/50825 215/250
3,409,181 A * 11/1968 McDonnell ..... B65D 1/323 222/211
3,410,456 A * 11/1968 Johnson, Jr. ..... B67D 1/0835 222/400.7

(Continued)

OTHER PUBLICATIONS

<https://www.genosgarage.com/product/jays-ez-funnel/tools>: Item #: JAYS-EZ-FUNNEL; Aug. 5, 2016; 1 page.

*Primary Examiner* — Benjamin R Shaw
(74) *Attorney, Agent, or Firm* — Banner & Witcoff, Ltd.

(57) ABSTRACT

A kit for use in combination with a squeeze bottle includes a bottle cap or plug configured to seat and seal multiple sizes of a bottle opening or spout by threaded attachment to or compression fit in the spout. The cap or plug includes an axial throughbore which receives multiple sizes and configurations of fluid tubes and discharge nozzles which when properly attached to an inserted into a squeeze bottle enables controlled pumping and discharge of fluid such as hydraulic fluid or liquids.

22 Claims, 15 Drawing Sheets

(56) References Cited

U.S. PATENT DOCUMENTS

| | | | | | |
|---|---|---|---|---|---|
| 3,545,475 | A * | 12/1970 | Johnson, Jr. | B67D 1/0802 | 137/212 |
| 3,572,558 | A | 3/1971 | Hooker | | |
| 3,756,478 | A * | 9/1973 | Podell | B65D 47/18 | 222/211 |
| 3,823,848 | A * | 7/1974 | Schuster | B65D 39/04 | 222/400.7 |
| 4,014,468 | A | 3/1977 | Silverman et al. | | |
| 4,133,462 | A * | 1/1979 | Lindstrom | B65D 47/128 | 215/214 |
| 5,025,955 | A * | 6/1991 | Stenger | B67D 1/0829 | 222/400.8 |
| 5,169,035 | A | 12/1992 | Imbery, Jr. | | |
| 5,249,714 | A | 10/1993 | Merhar | | |
| 5,803,310 | A | 9/1998 | Soon | | |
| 6,363,979 | B1 * | 4/2002 | Chafin | B65D 47/061 | 141/114 |
| 2010/0018972 | A1 * | 1/2010 | Kao | B65D 51/1633 | 220/212 |
| 2011/0147405 | A1 * | 6/2011 | Blinn | B65D 51/1611 | 222/1 |
| 2014/0138386 | A1 * | 5/2014 | Blanchard | B65D 39/0029 | 220/379 |
| 2014/0158721 | A1 * | 6/2014 | Fishman | B65D 47/06 | 222/567 |

* cited by examiner

CONTAINER THROAT DISPENSING ADAPTER AND METHOD

CROSS REFERENCE TO A RELATED APPLICATION

This is a utility patent application derived from, relating to and incorporating by reference U.S. Patent Application Ser. No. 61/990,599 entitled Container Throat Dispensing Adapter and Method, filed on May 8, 2014 for which priority is claimed.

BACKGROUND

In the automotive industry, servicing driveline fluids has become more complex. With a multitude of different blends, viscosities and retail container packaging, pouring required lubrication fluids into a funnel to reach a service fill port is no longer a convenient or simple task. Most service applications do not involve a dipstick or similar means of checking fluid levels that require service. Most service fill ports are accessed at locations underneath the vehicle and are difficult to reach or obstructed by body or vehicle frame components. Typical transmissions and axle differentials can only be serviced with some type of fluid transfer pumping method to replenish the fluid since they cannot be filled by gravity flow.

Present alternative methods have drawbacks. For example, some retail package squeeze type fluid bottles have a tapered spout cap and one must invert the container to remove it contents by grasping and squeezing the bottle and or attaching a length of flexible hose to reach inaccessible service port. This method creates numerous problems. (1) The flexible hose usually has a poor fit on the smooth tapered container spout and slides off. (2) The length of flexible hose may have a smaller inside diameter than the tapered container spout precluding a positive connection to the spout. With the smaller diameter length of hose, fluid transfer is restricted and requires more internal bottle pressure by squeezing and/or by a clamping device on such container. (3) With higher internal bottle pressure required for transferring such fluid, the poor fit of a flexible hose installed on a tapered spout leads to a very high percentage of the hose disconnecting from the spout end. (4) When the hose connection fails and the fluid being transferred is a lubricant, not only may leak that needs attention may result, but also the spout end becomes lubricated, which complicates the retaining of the flexible hose connection to the spout end. (5) The tapered spout cap design, does not allow use of some type of a hose retaining/clamping device. (6) When the service fill port is located at a higher location and obstructed, for example, by a structural frame member, a longer flexible hose is required to reach the service fill port. This compounds the existing problems of fluid transfer. Further, because the container still needs to be inverted to remove all contents, which usually requires even a longer flexible hose. This compounds fluid transfer resistance. (7) Most squeeze type lubricant fluid bottles in the retail market have a foil gasket seal of some type under the threaded spout cap. This gasket prevents fluid content leakage until used by the end consumer and must be removed prior to usage. If the gasket seal is not completely removed from the bottle throat top, the spout cap will not create a liquid impervious seal and leakage may then occur when increasing internal bottle pressure to pump fluid contents. Even with all of the gasket seal removed, bottle manufacturing tolerances are inconsistent and a poor fit to a bottle throat by a spout cap may result in leakage. (8) When such a task is done, the length of flexible hose needs to be cleaned so if used again with a different type of fluid, contamination will not occur.

One solution enabling use of an original factory package (container/vessel) is to provide an additional pump mechanism that threads onto the bottle. This method creates numerous problems also: (1) It may require a hand pump that threads onto the container with a long length of flexible hose to reach the service fill port. (2) The pump mechanism needs to be designed exclusively for the bottle thread pitch and depth. (3) Holding the container/bottle with one hand and operating a hand pump with the other hand may cause the flexible hose to become loose and not retained in a service port and possibly disconnect thereby creating leakage. (4) Most pumps are poorly made and leak around the pump seal handle after a few usages. (5) After usage, cleanup of such pump assemblies are very difficult and time consuming. Cleaning solvents to completely remove all fluid contaminates for the next usage may be required. Cleaning solvents may be harsh and attack the pump components and increase the rate of pump seal and hose failure. (6) Upon usage over time, the flexible hose may become stiff or rigid due to being subjected to chemicals, which makes use and cleaning difficult. (7) When not in use, storage of such pump and hose assemblies requires some type of residue leakage containment.

Additional alternate methods of fluid replacement include transfer of fluid lubricant into a separate container or pumping device to reach a service port. This coincides with recent changes of lubrication fluids and packaging. Most factory retail packaging has changed bottle design of throat size and thread pitch. This requires an additional external container to be filled first with the original fluid contents, and then dispensed by some type of pumping method.

These alternative methods have created numerous problems also: Method (ONE) The use of a hand suction pump or a push pull pump with multiple flexible hoses. (1) Requires the hose of the suction cylinder to be inserted into fluid container to pull fluid into the suction cylinder, and then pump into the service port. This type of method creates residue on the external part of the hose which, in turn creates a mess. (2) Requires use of both hands to operate, leaving the hose loose in the service port for possible leakage. (3) Most hand suction pumps are difficult to use with higher viscosity/thicker fluids. (4) Most hand suction pumps leak after a few usages. (5) Usage over time may cause, the flexible hose to become stiff or rigid due to being subjected to chemicals. (6) When operating a push/pull pump, one end of a hose is inserted into the fluid container and the other end is inserted to the service port. Both hose ends are loose in their perspective ports. The most common failure is that the fluid supply bottle is not being secured thereby tipping the fluid container due to hose movement while pumping. (7) Once service of fluid is completed, the amount of fluid residue in the hoses leaks until transferred to the next container or cleaned for storage.

Alternate Method (TWO) In-line hand powered, electric or pneumatically powered rotary pumps require use of both hands to operate the pump with two long flexible hoses, one on each end. The same problems as alternate method (ONE & TWO) are observed.

Alternate Method (THREE) Air pressurized container to push fluid through a flexible hose to service port, (1) Requires service fluid to be transferred first to a vessel/container. Then the container is pressurized by means of a hand air pump or compressor. (2) A length of flexible hose from pressurized container to reach the service port location is required. (3) Some type of shut off valve when servicing is required to stop fluid dispensing. (4) Man of the same problems as observed for methods ONE and TWO are observed. (5) Cleanup is more complicated and time consuming. (6) System is not a cost effective for the end user.

BRIEF SUMMARY OF THE INVENTION

It is therefore an objective of the present invention to provide an improved method for removal of fluid from the original manufactured retail package squeeze type fluid bottle where pressure is required to transfer such fluid. With the container throat dispensing adapter disclosed and installed on an original retail bottle, the bottle will become the fluid container and a pump mechanism to dispense such fluid.

In accordance with a first aspect of the invention, the tapered adapter or plug can be inserted into a bottle throat opening against the interior wall thereof. The tapered adapter will create a liquid impervious seal between the internal part of the bottle throat interior wall opening and a tapered adapter. Then a plastic extension tube assembly may insert through a center bore of the adapter. Upon continuing to push the extension tube assembly through the tapered adapter, contact is made with the inside base of the bottle. This will allow all the fluid in the bottle to be removed through the extension tube assembly by creating internal bottle pressure by means of grasping and repeatedly squeezing the bottle to pump the fluid outward from the bottle to the service port location.

According to a second aspect of the invention, a threaded cap adapter may include multiple diameter threads which consist of two or more separate sizes to enable engagement with multiple bottle throat sizes. The threaded adapter replaces a bottle cap and screws onto the bottle throat opening where the original threaded twist off cap was located. Also a cylindrical spout in the threaded cap with a bore receiving a plastic extension tube assembly may be inserted into the bottle to reach the bottle fluid contents. This will allow all the fluid in the bottle to be removed through the extension tube assembly by causing internal bottle pressure by means of grasping and squeezing the bottle to pump the fluid outward and, if necessary, upward to the service port location.

According to a third aspect of the invention, a threaded cap adapter may employ two or more separate sizes. The smaller cap adapter fits a smaller bottle throat size and the larger cap adapter fits a larger bottle throat size. The adapters screw on to the bottle throat opening where the original threaded twist off cap was located. Both small and large cap style adapters include a cylindrical spout and a throughbore into which the plastic extension tube assembly can be inserted and extend to reach the bottle fluid contents. This will allow all the fluid in the bottle to be removed through the extension tube assembly by creating internal bottle pressure by means of grasping, and repeatedly squeezing the bottle to pump the fluid outward and upward, if necessary, to a service port location.

According to a fourth aspect of the invention, a threaded cap adapter comprises a large size that fits a larger bottle throat size. The large size cap adapter typically includes a cylindrical spout and a throughbore through which a plastic extension tube assembly inserted to reach the larger size bottle fluid contents. A smaller adapter has internal and external threads with a larger throughbore. This smaller threaded adapter can be threaded into the larger cap adapter and reduces the adapter cap assembly to fit the smaller bottle throat size. These adapters screw on to the threaded bottle throat opening where the original threaded twist off cap was located. This will allow all the fluid in the bottle to be removed through the extension tube assembly by creating internal bottle pressure by means of grasping and squeezing the bottle to pump the fluid upward to the service port location.

According to a still further aspect of the invention, the adapters enable repositioning the pick-up extension tube in the adapter cap throughbore and dispensing of fluid with the bottle angled or inverted to reach a lower service port location. This allows dispensing of some or all the fluid from the bottle into an obstructed reservoir service fill port without the use of a funnel.

According to yet another aspect of the invention, a step-by-step process and method enables use of a retail package squeeze type fluid bottle by modifying the original bottle cap spout to accept an internal extension tube assembly and to cooperate with multiple size bottle openings.

These and other objects, aspects, advantages and features of the invention and the embodiments are set forth in the following detailed description.

BRIEF DESCRIPTION OF THE DRAWING

In the description which follows reference will be directed to the following figures.

DETAILED DESCRIPTION

Figure 1:
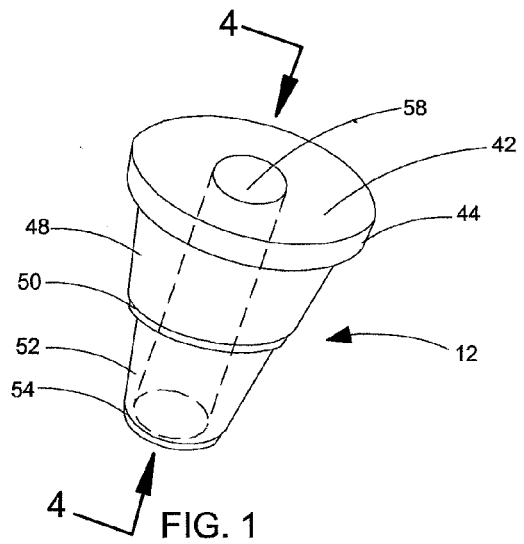
FIG. 1 is a perspective view of the multiple stepped, tapered bottle plug or stopper adapter.
Figure 2:
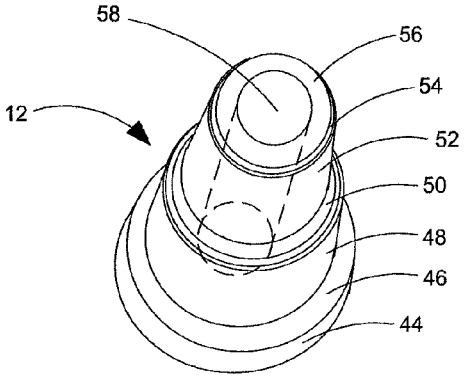
FIG. 2 is a perspective view of the multiple stepped tapered adapter in FIG. 1 viewed from the bottom side thereof.
Figure 3:
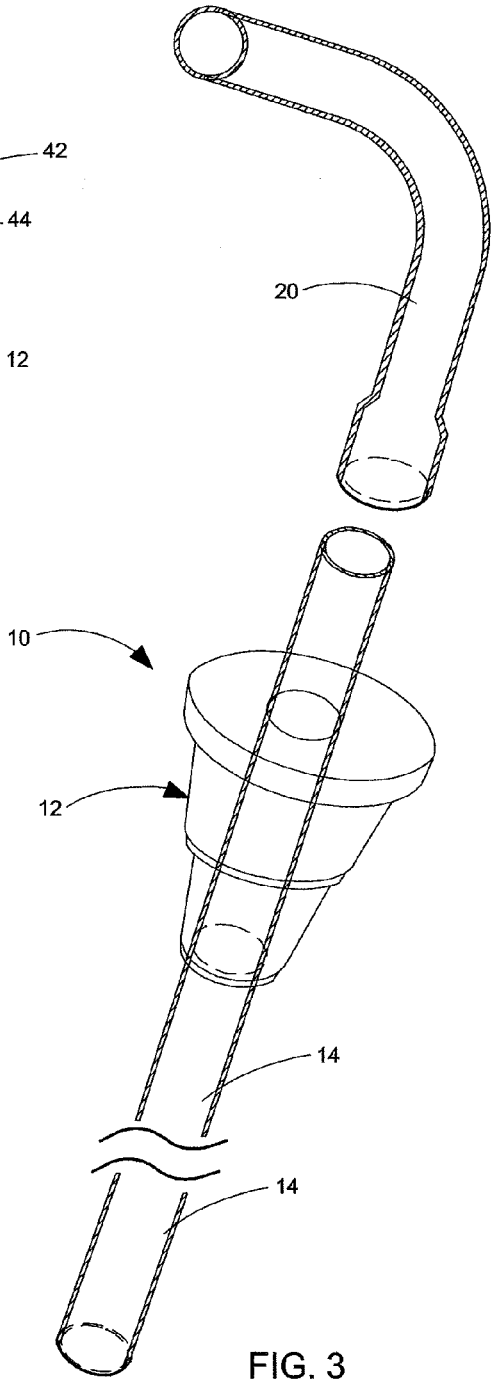
FIG. 3 is a perspective view of the multiple stepped tapered adapter in FIG. 1 with a plastic tube extension and elbow tube extension.

A universal, tapered, multiple section, rubber or elastic adapter or plug with a throughbore is designed to fit multiple types of industry standard sizes of squeeze type fluid bottle dimensions and throat openings available in the retail market. Since an embodiment of the stepped, tapered, rubber adapter may be inserted into the inside of a bottle opening or throat interior wall, it does not rely upon the external bottle threads to make a liquid impervious seal similar to a threaded screw on cap. Referring to FIGS. 1-3, the stepped tapered adapter is typically comprised of medium softness and elastic urethane. This allows a snug, positive fit of the adapter or plug to conform or mold itself to the internal wall at the bottle throat opening. The tapered adapter comprising a pliable material provides a liquid impervious seal obviating manufacturing distortion that can be a factor in a threaded cap or bottle opening. When a plastic extension tube is inserted through the bore in the plug or adapter, the adapter may be expanded or radially outwardly compressed with a sealing force on the throat interior or wall of the bottle opening. Continuing, to insert the plastic extension tube through to make contact with the base of the fluid container, allows vertical dispensing of fluid, such as lubricant, by using the original retail bottle as a pumping device. Grasping and squeezing the flexible material bottle creates a positive pressure inside the bottle forcing fluid out through the extension tube. Upon releasing pressure or squeezing of the bottle, the pliable plastic bottle container will assume its original shape and allow air to enter the bottle through the extension tube to replace the fluid contents forced out thereby enabling a further cycle of compressing the container for continued dispensing of lubricant or fluid. Elbow tube adapters can be attached to the discharge end of the extension tube to access service fill ports in a vertical or a horizontal position.

Figure 4:
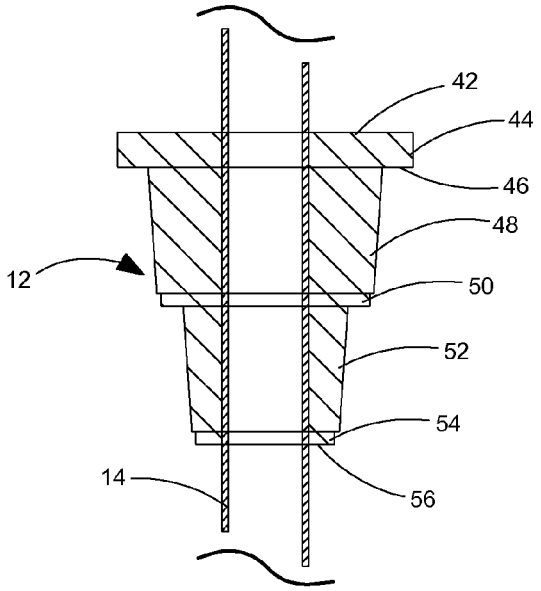
FIG. 4 is a vertical sectional view of the multiple stepped tapered adapter taken along line 4-4 of FIG. 1.
Figure 5:
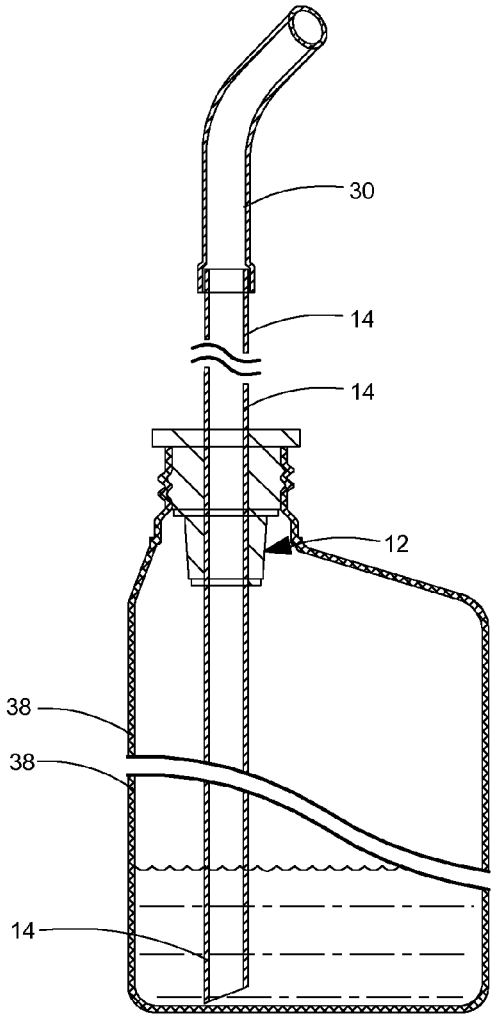
FIG. 5 is a reduced scale view of FIGS. 3 and 4, in combination with an example of an original package lubricant bottle with a large throat bottle opening.
Figure 6:
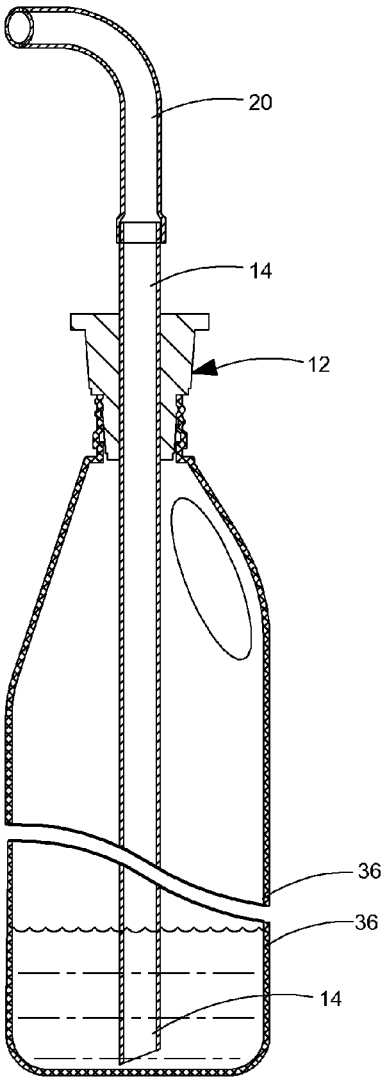
FIG. 6 is a reduced scale view of FIGS. 3 and 4, in combination with an example of an original package lubricant bottle with a small throat bottle opening

FIG. 5 and FIG. 6 depict different sizes of common squeeze type fluid containers or lubrication bottles 36, 38 that have a smaller or a large throat diameter or opening and other different physical designs. FIG. 5 depicts a tapered step adapter or plug 12, used in the position of a larger diameter section 48, shown in FIG. 4 of a two or dual tapered size plug 12 in combination with an extension tube 14 that extends substantially to the inside base 38 of the bottle 36. FIG. 6 depicts the tapered step adapter 12, used in the position of the smaller diameter section 52 of the two tapered sections 48, 52 of FIG. 4 along with an extension tube 14 extended the inside to the base of the bottle 36 and incorporating an elbow tube adapter 20 at the discharge end of tube 20.

Figure 9:
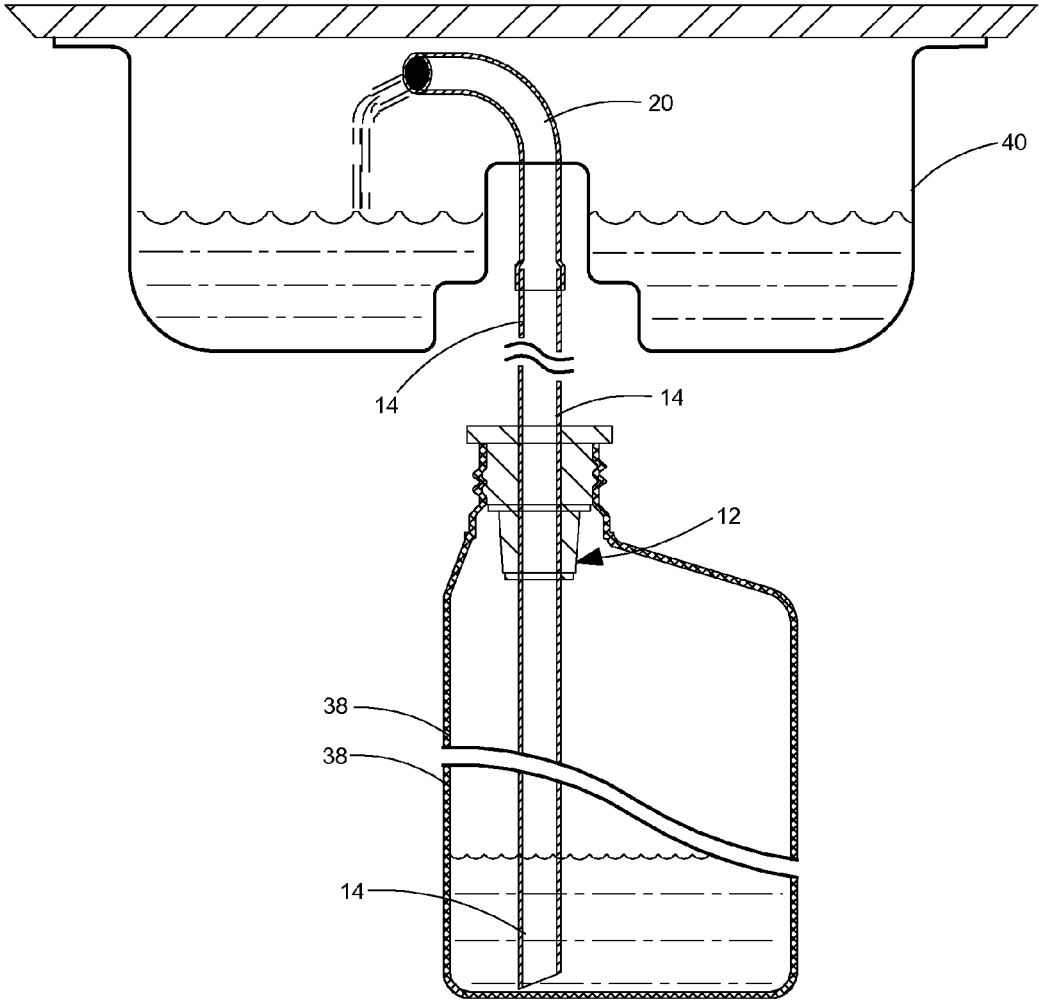
FIG. 9 is a perspective view depicting a method of use of an embodiment of the invention.

FIG. 9 illustrates a machinery component such as an automatic transmission and reservoir or pan 40 that requires servicing or filling from a bottom service port location. Servicing requires vertically filling the transmission reservoir 40 through a bottom port until the fluid level reaches the top of a fill port and leaks out to provide the correct fluid level. Typically there is no indicator or reference for this common application such as a dipstick for checking the compliance with proper recommended fluid level. Using the present invention enables filling the reservoir 40 and detection of complete filling. Using the stepped tapered rubber plug or stopper or adapter 12 inserted into the throat of bottle 38 and then inserting the ridged plastic extension tube 14 through the throughbore 58 (in FIG. 1) to contact at or near the base of the bottle 38 and combining this assembly with the depicted arcuate elbow adapter 20 may then be used for filling reservoir or pan 40 to the proper level. The fluid is disbursed by means of creating internal bottle pressure by grasping and squeezing the bottle 38 and then by releasing the squeeze bottle 38. A further volume of fluid may then be dispensed from the bottle 38 by squeezing the bottle 38 to compress the fluid with air drawn back through the extension tube 40 and discharge elbow 20 assembly. This comprises as a pumping method to dispense fluid.

Figure 7:
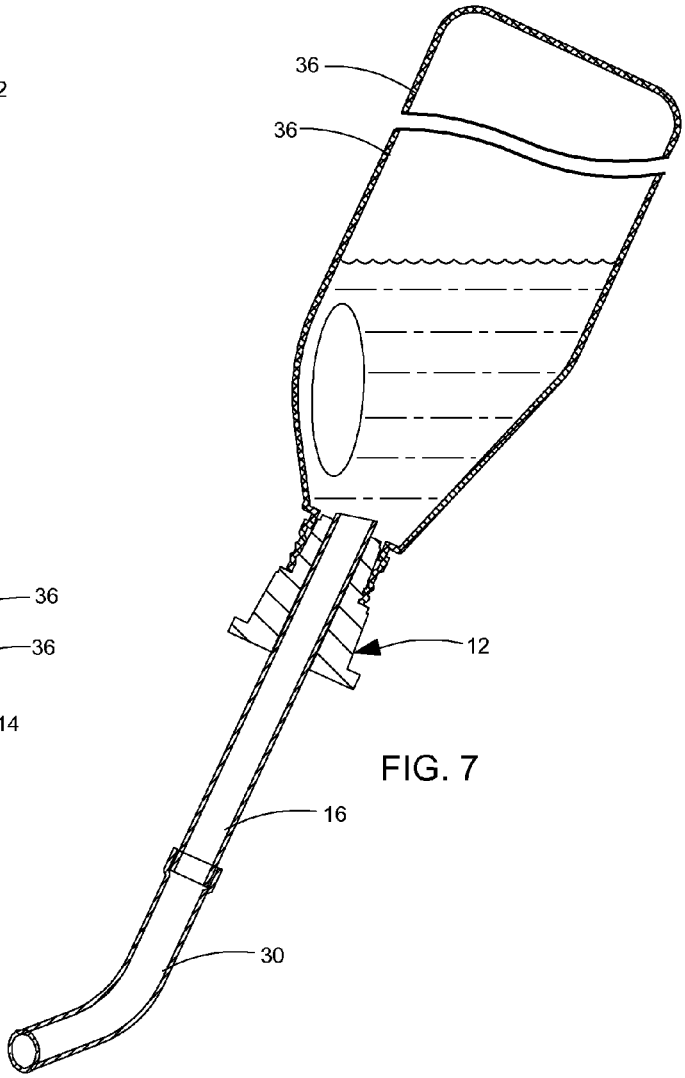
FIG. 7 is similar to FIG. 6 with a lubricant bottle assembly partially inverted.

FIG. 7 depicts another method to reach a service port that is in a lower location with limited access. A bottle 36 of a different design and a smaller throat or opening size is combined with a shorter plastic extension tube 16 incorporating a different elbow discharge adapter tube 30. This allows a more calibrated and controlled amount of fluid to be dispensed and is useful when a straight funnel will not access the service fill port.

The stepped tapered rubber adapter 12 is typically injection-molded or cast urethane with medium shore hardness. An example is depicted in FIG. 1, FIG. 2 and FIG. 4. The stepped tapered adapter typically consists of multiple frusto-conical steps or tapered sections 48, 52. A cylindrical throughbore 58 plug of 12 has a diameter slightly less than the outside diameter of the extension tube 14. This arrangement creates a liquid impervious seal around the extension tube 14 outer wall and retains the extension tube 14 position in throughbore 58. When such an extension tube 14 is inserted, the stepped tapered adapter 12 expands slightly larger in overall diameter for more positive sealing force on internal wall at the throat opening of a bottle. The bottom flat surface 56 of the tapered adapter 12 and lesser radius surface 54 of lower end of plug 12 facilitates inserting the tapered adapter 12 into the interior of the smaller bottle throat openings. The adapter 12 thus has slight tapered conical surfaces smaller at the very bottom of plug 12, with a cylindrical positive expanding taper upward towards the top of the tapered section. This provides a positive sealing force for different bottle throat sizes and compensates for opening manufacturing inconsistencies of bottle openings. Plug section 48 also includes a conical surface diameter section 50 at the bottom, with a positive increasing taper upward towards atop section 44. The slight cylindrical positive expanding taper upward thereby provides a positive sealing force upon insertion into larger bottle size openings and compensates for manufacturing inconsistencies conical lid section 44 and provides a hand hold for installing and removing the tapered adapter or plug 12.

Figure 8:
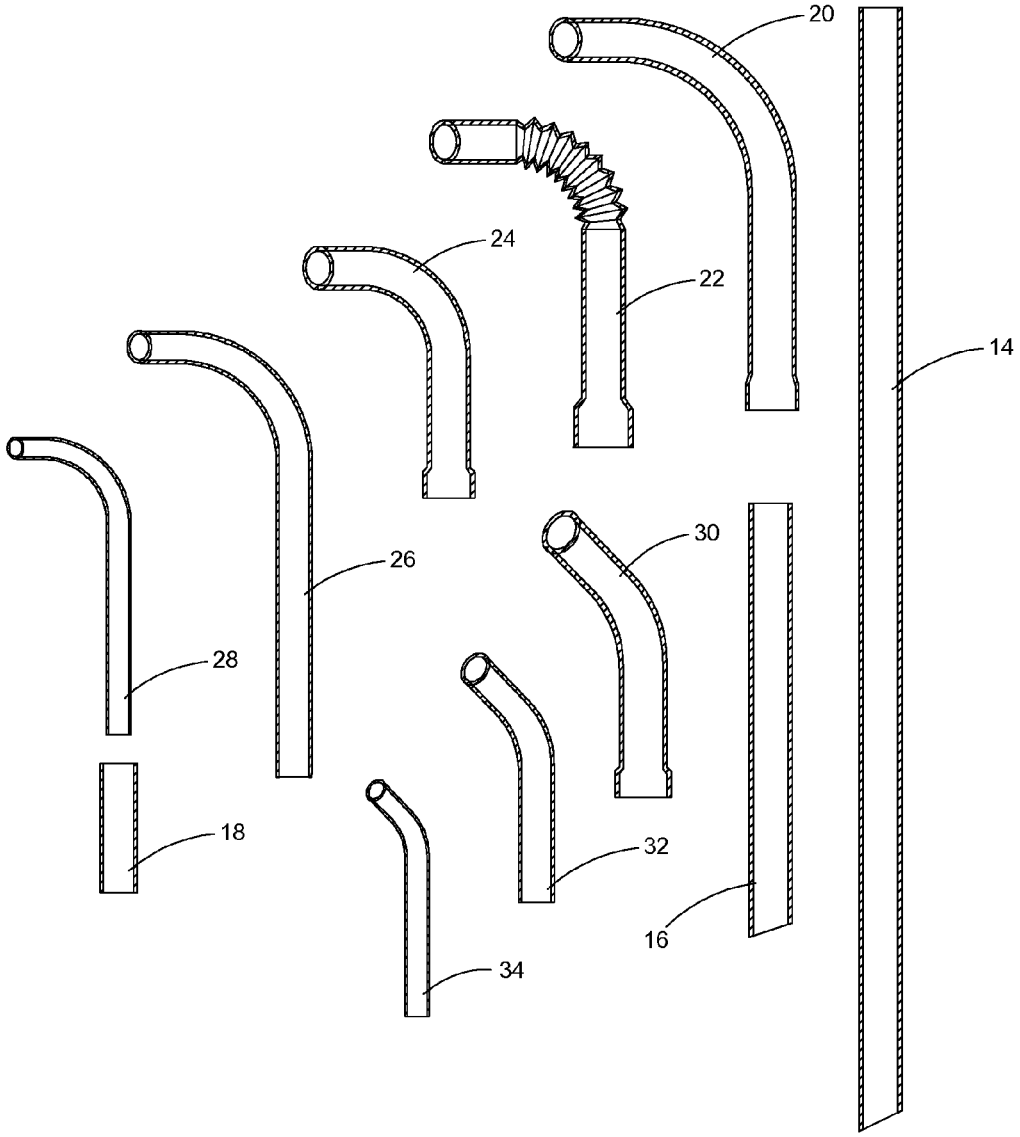
FIG. 8 is a perspective view depicting different plastic extension tubes.

FIG. 4 illustration is a sectional view of a tapered adapter, plug or stopper 12 with extension tube 14. FIG. 8 shows the different diameters and configurations of extension tubes and adapters to access different types of service port designs. The tubes are typically made of polyethylene or polypropylene extruded tubing. Bottle extension tubes 14 and 16 are larger diameter to permit flow of high viscosity fluids, such as differential gear oil. Discharge tips or tubes 20, 22, 24, and 30 have an expanded connection end that fits over the extension tubes 14 and 16. This maintains the larger inside diameter for less restrictive flow of fluid.

Adapter 22 is convoluted or flexible at one end to provide a range of multiple angle requirements. Adapters 26 and 32 have a diameter size which enables placement into the throughbore 58 inside diameter of the larger tubes 14, 16, 20, 22, 24 30 with a slight interference fit to create a positive seal between the inner and outer walls. Adapter 18 is straight and has the same outer diameter as adapter 32. Tube 18 is used to fit inside the larger tubes 14, 16, 20, 22, 24, 30 as a bushing for adapters 28 and 34. Also adapters 28 and 34 fit inside adapters 26 and 32.

Figure 11:
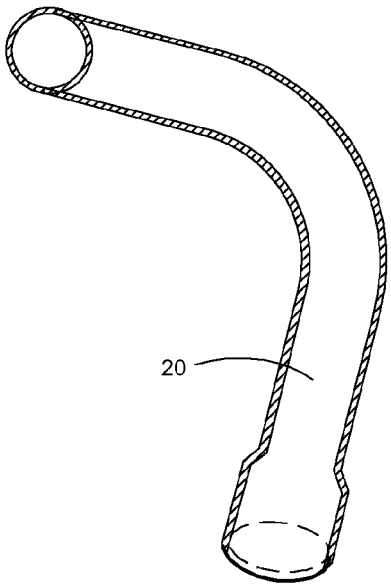
FIG. 11 is a sectional perspective view of a multiple threaded cap adapter.
Figure 11:
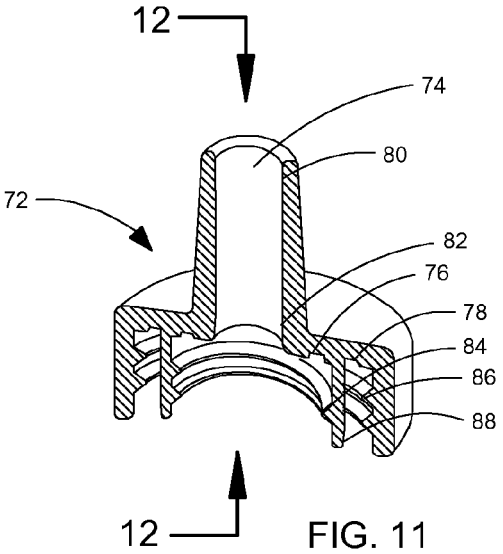
Figure 10:
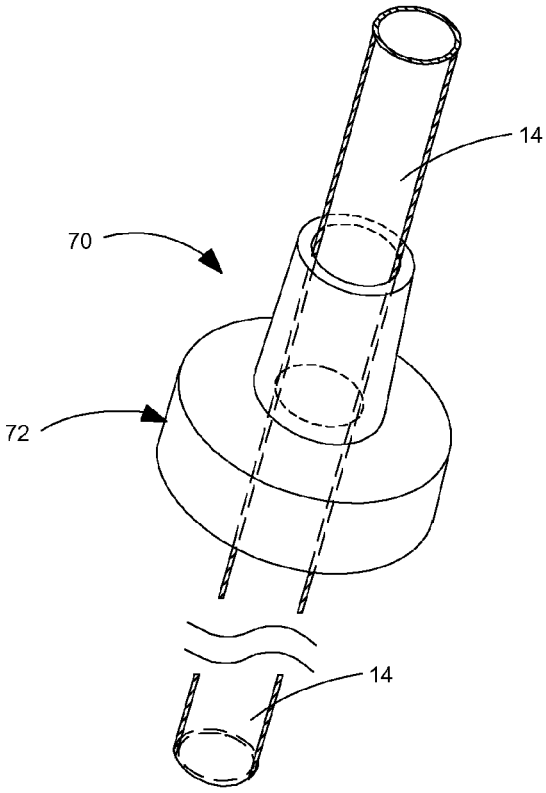
FIG. 10 is a perspective view of a multiple threaded cap adapter with a tube extension and elbow tube extension in combination.
Figure 12:
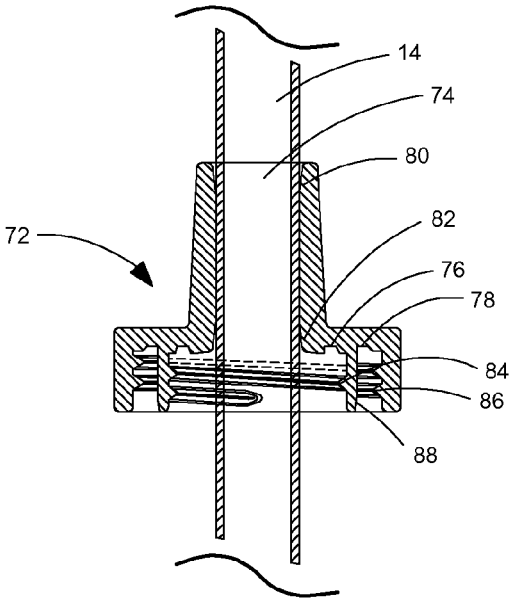
FIG. 12 is a vertical sectional view of the multiple threaded cap adapter taken along line 12-12 of FIG. 11.
Figure 13:
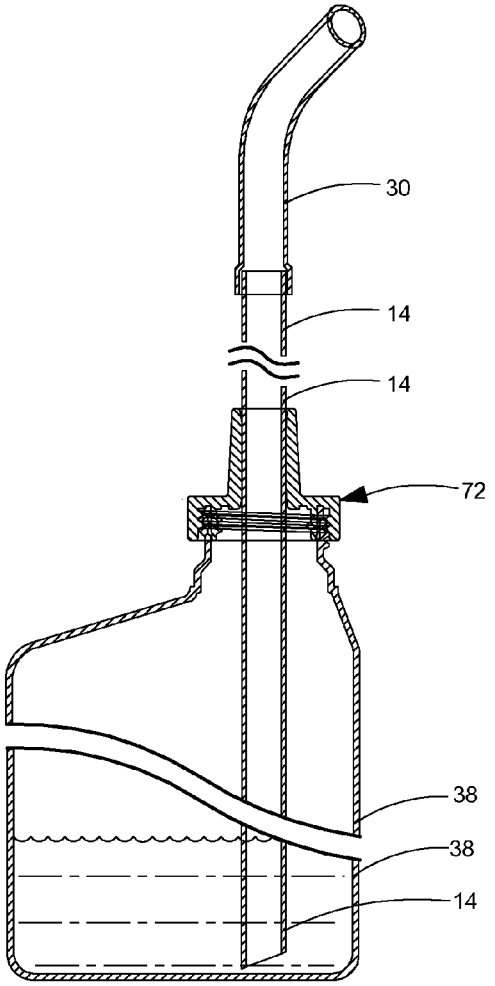
FIG. 13 is a sectional view the embodiment depicted in FIGS. 10, 11 and 12, incorporating an example of an original package lubricant bottle with a large throat.
Figure 14:
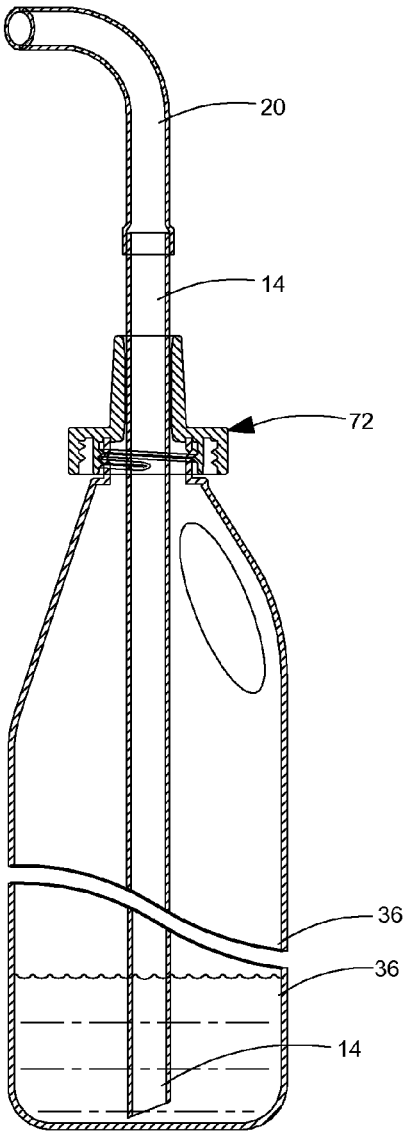
FIG. 14 is a sectional view of the embodiment depicted in FIGS. 10, 11 and 12, incorporating an example of an original package lubricant bottle with a small throat.

FIG. 10 depicts an embodiment of an assembled perspective design of a threaded adapter cap for a squeeze type fluid bottle. Threaded cap 72 incorporates two different sizes of internal thread sizes. FIG. 11, FIG. 12 and FIG. 13 depict sectional views. A spout tip 74 incorporates a smaller inside diameter cylindrical throughbore 80 which accommodates plastic extension tube 14 with an interference fit to retain the extension tube 14 in position. Bore 80 is internally tapered outward from lower end 82 to spout tip 74 to aid insertion of plastic extension tube 14. This provides a liquid impervious seal to the bore of tubes 74 and 14. An annular female recess cavity 76 is provided for sealing of a small squeeze type fluid bottle 36 throat top opening. This structure creates a positive sealing force to the bottle top throat when the adapter 72 is threaded on by internal thread 88. FIG. 14 shows cap adapter 72 threaded onto the small squeeze type fluid bottle 36 as an assembly incorporating extension tube 14 extended to the base of the bottle 36 and including an adapter elbow 20.

FIG. 12 depicts an annular female recess cavity 78 for seating in a larger squeeze type fluid bottle 38 throat top opening using a threaded cap embodiment of the invention. This arrangement creates a positive sealing force to the bottle top throat when the adapter 72 is threaded on by internal thread 86. The external surface 88 of the inner cap is slightly tapered at the outer bottom of the internal cap to thereby compress against the larger squeeze type fluid bottle internal throat slightly to aid in sealing in the cavity 78 when the adapter cap is threaded thereon. FIG. 13 depicts a cap adapter 72 threaded onto the larger squeeze type fluid bottle 38 as an assembly incorporating extension tube 14 extended to the base of the bottle's fluid. Adapter elbow 30 is attached to outer end of tube H.

FIG. 14 is a sectional view depicting the placement of a threaded cap adapter 72 embodiment in combination with a tube 14 and an extension elbow 20 affixed to a bottle 36 having a small threaded throat opening. The adapter 72 includes an annular threaded section such as depicted as threaded section 84 in FIG. 11 which is threaded onto the top of the bottle 38 and more particularly to the threads thereof. The annular recess 76 seals the adapter or cap 72 to the bottle opening. In contrast, FIG. 13 depicts the cap construction of FIG. 11 wherein the threads 86 are mated with a larger opening of bottle 38. Again, an annular recess 78 seals the cap into position in the bottle opening of the embodiment as depicted in FIG. 13.

Figure 15:
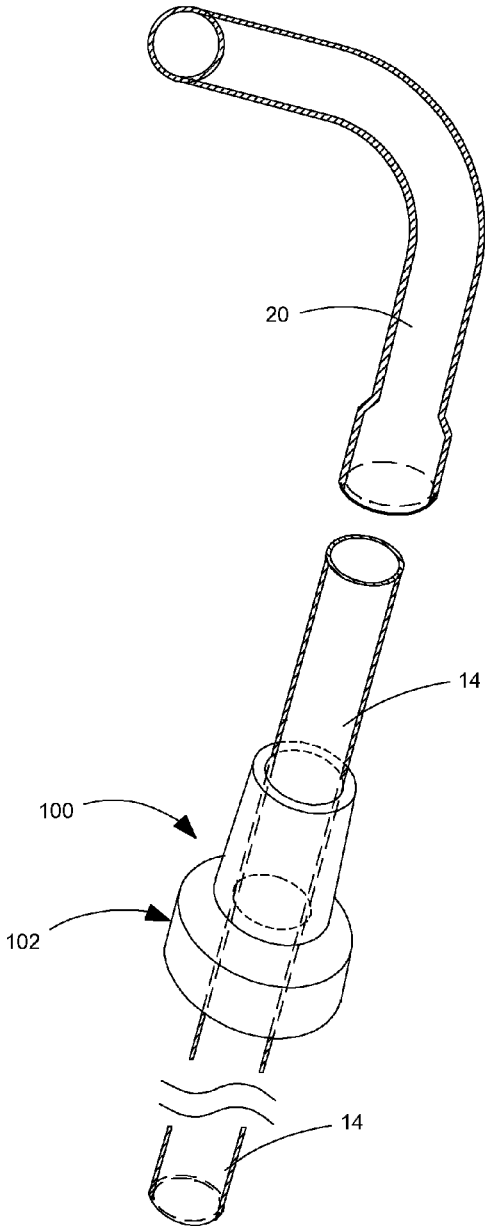
FIG. 15 is a perspective view of a smaller threaded cap adapter with a plastic tube extension and elbow tube extension adapter as an assembly.
Figure 16:
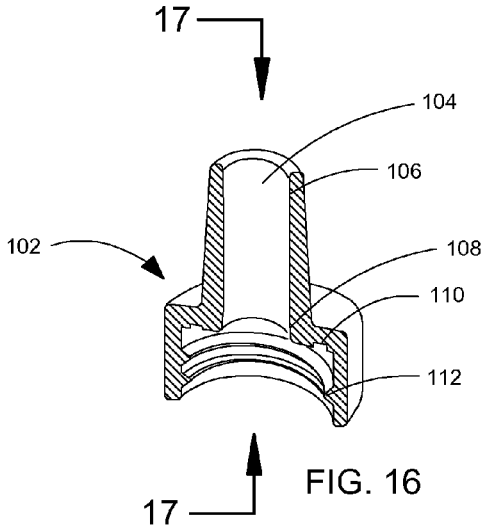
FIG. 16 is a sectional perspective view of a smaller threaded cap adapter.
Figure 17:
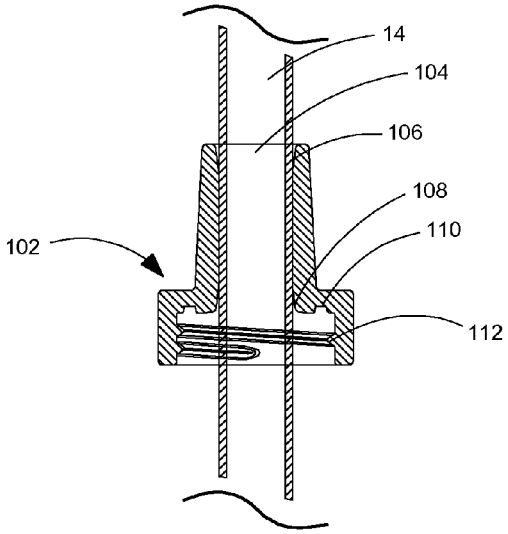
FIG. 17 is a vertical sectional view of the smaller threaded cap adapter taken along line 17-17 of FIG. 16.
Figure 21:
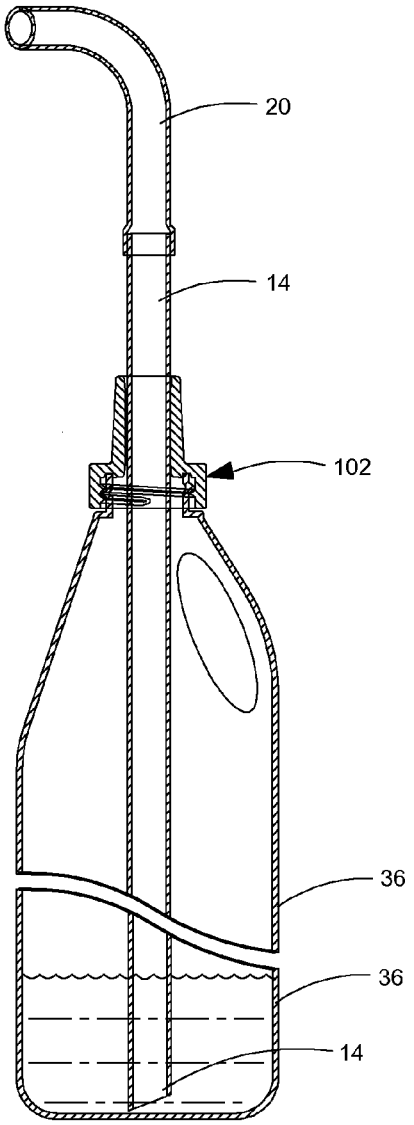
FIG. 21 is a sectional view of the embodiment depicted in FIGS. 15, 16 and 17, incorporating an example of an original package lubricant bottle with small throat.

FIG. 15 is another assembled perspective design embodiment of an adapter cap assembly for a smaller squeeze type fluid bottle 36. A threaded cap 102 incorporates internal thread size for smaller squeeze type fluid bottle 36. FIG. 16 and FIG. 17, show the sectional views. A spout tip 104 incorporating a smaller inside diameter cylindrical throughbore accommodates plastic extension tube 14 with an interference fit to retain the extension tube 14 in position. Tapered outward sections 106, 108 at each end of tip 104 aid in inserting plastic extension tube 14. This provides a liquid impervious seal to the bore of tip 104 and plastic extension tube 14. A female recess cavity 110 for the small squeeze type fluid bottle throat top opening 36 creates a seat for a positive sealing force to the bottle top throat when the adapter 102 is threaded on by internal thread 112. FIG. 21 shows a cap adapter 102 threaded onto the small squeeze type fluid bottle 36 as an assembly incorporating extension tube 14 extended to the base of the bottle fluid. An adapter elbow 20 is affixed to the outer end of tube 14.

Figure 18:
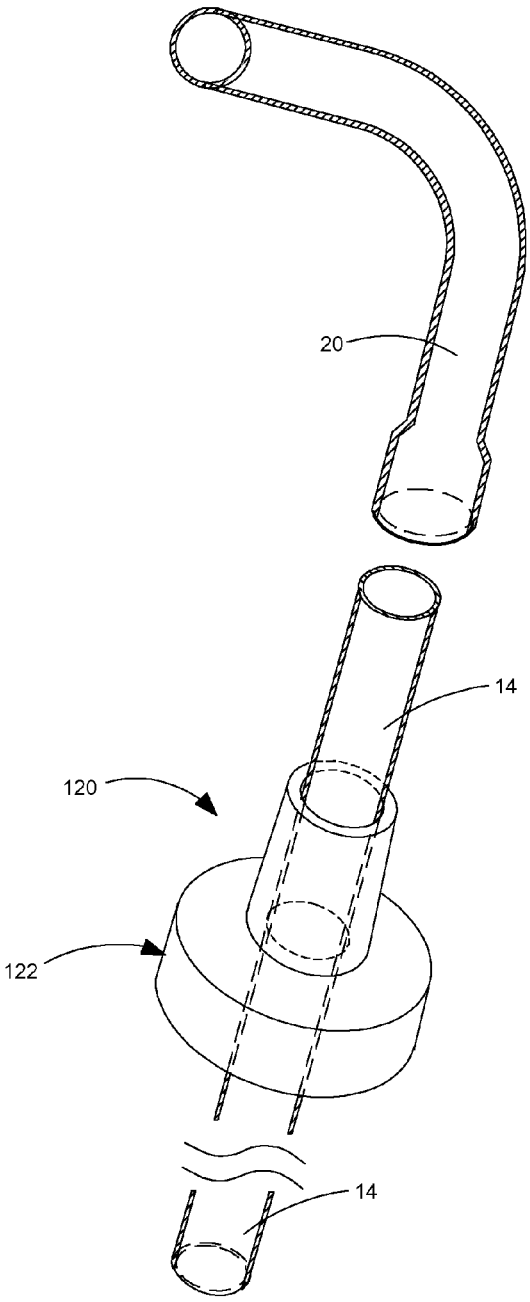
FIG. 18 is a perspective view of a larger threaded cap adapter with a plastic tube extension and elbow tube extension.
Figure 19:
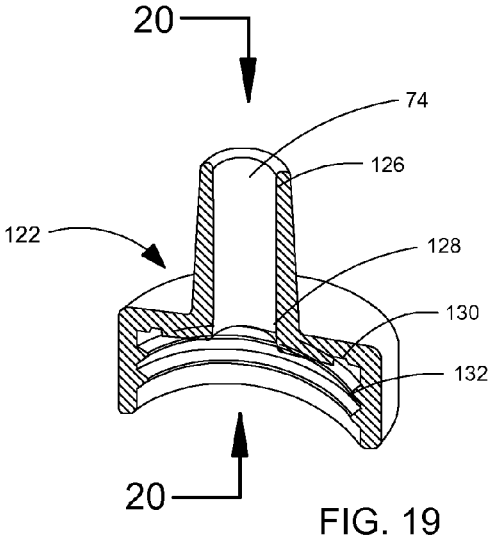
FIG. 19 is a sectional perspective view of a larger threaded cap adapter.
Figure 20:
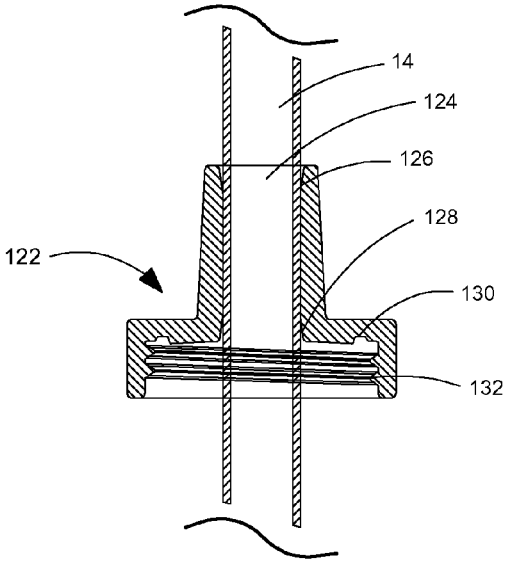
FIG. 20 is a vertical sectional view of the smaller threaded cap adapter taken along line 20-20 of FIG. 19.
Figure 22:
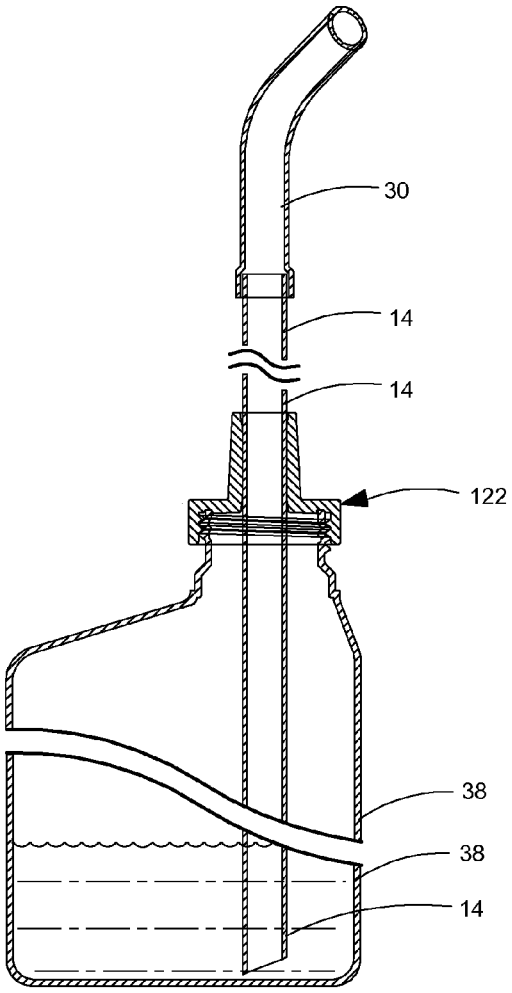
FIG. 22 is a sectional view of the embodiment depicted in FIGS. 18, 19 and 20, and incorporating an example of an original package lubricant bottle with a large throat.

FIG. 18 is a perspective view of an assembled embodiment of a adapter cap assembly for a larger squeeze type fluid bottle 38. A threaded cap 122 incorporates an internal thread size for a larger squeeze type fluid bottle 38. FIG. 19 and FIG. 20, depict sectional views of a spout tip 124 incorporating a smaller inside diameter cylindrical throughbore which accommodates plastic extension tube 14 with a interference fit to retain the extension tube 14 in position. Tapered sections 126, 128 diverge outwardly at each end of tip 124 to aid in inserting plastic extension tube 14. This provides a liquid impervious seal to the bore of tip 124 and plastic extension tube 14 outer wall. A female recess cavity 130 for the larger squeeze type fluid bottle throat top opening 38 to seats and seals, the bottle top throat when the adapter 122 is threaded on by internal thread 132. FIG. 22 shows cap adapter 122 threaded onto the larger squeeze type fluid bottle 38 as an assembly incorporating extension tube 14 extended into the base of the bottle's fluid.

Figure 23:
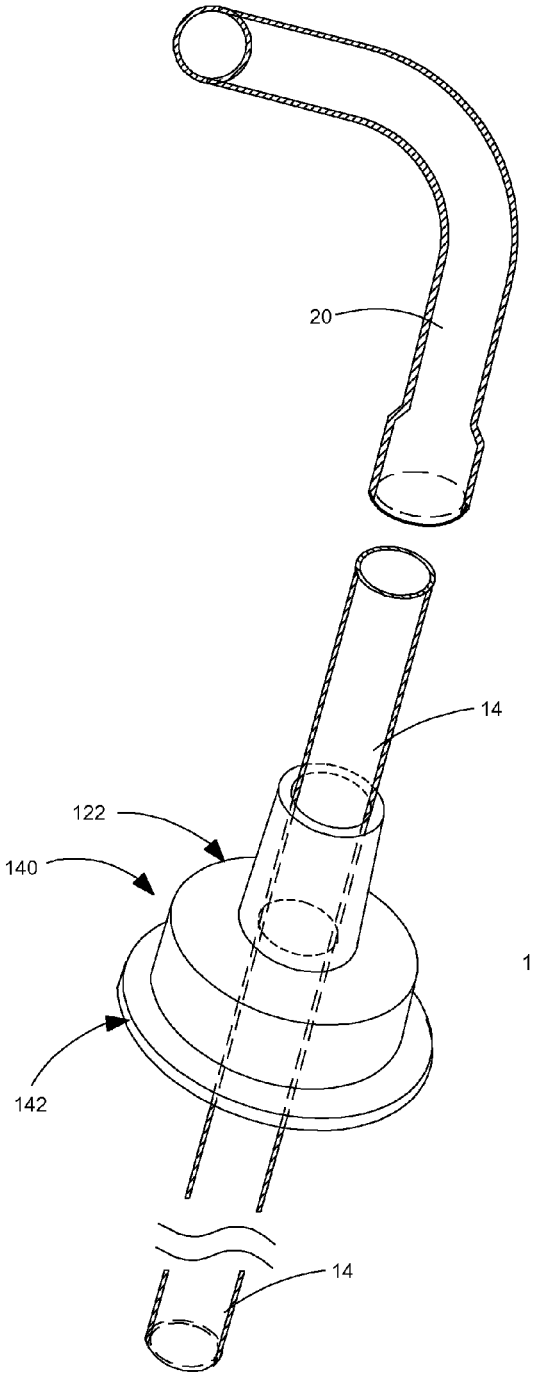
FIG. 23 is a perspective view of a larger threaded cap adapter with a plastic tube extension and elbow tube extension.
Figure 24:
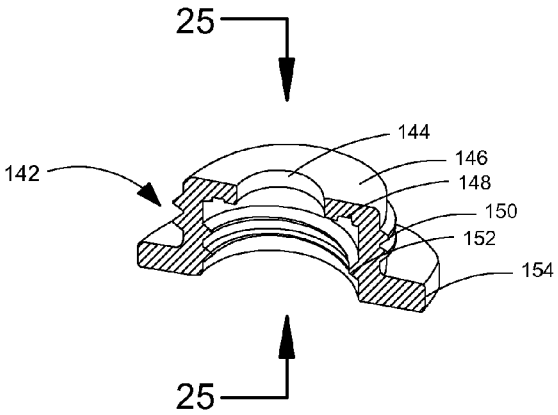
FIG. 24 is a sectional view perspective view of a threaded external/internal threaded adapter.
Figure 25:
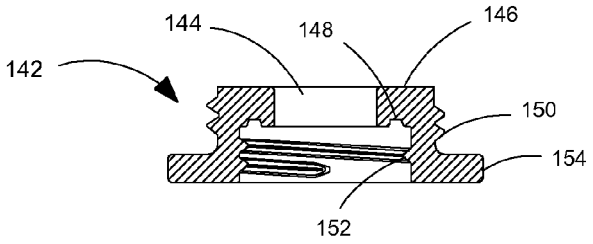
FIG. 25 is a vertical sectional view of the threaded external/internal adapter taken along line 25-25 of FIG. 24.

FIG. 23 is another assembled perspective view of a adapter cap embodiment for smaller and larger squeeze type fluid bottles 36, 38. A threaded cap 122 incorporates an thread 132 sized for a larger squeeze type fluid bottle 38. An internal adapter 142 is separately provided for the smaller squeeze type fluid bottle 36. FIG. 19 is a sectional perspective view of cap 122. FIGS. 24 and 25 depict the sectional views of the internal threaded adapter 142 with a throughbore 144. The top flat surface 146 of cap 122 provides a liquid impervious seal between the adapter 142 and cap 122. A female recess cavity 148 for a smaller squeeze type fluid bottle 38 throat top opening provides a seat to create a liquid impervious sealing force to the bottle top throat when the adapter 142 is threaded on by internal thread 152. External thread 150 threads 132 of cap 122. Outer flange boss 154 provides a handgrip hold for threading adapter 142 into cap 122.

Figure 26:
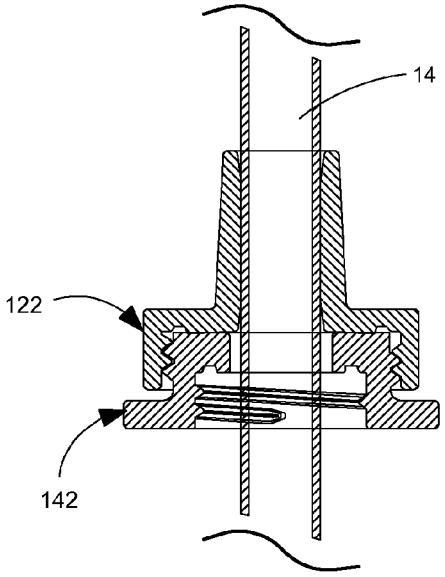
FIG. 26 is a sectional perspective view a combination of adapters of FIG. 25 and FIG. 20.
Figure 27:
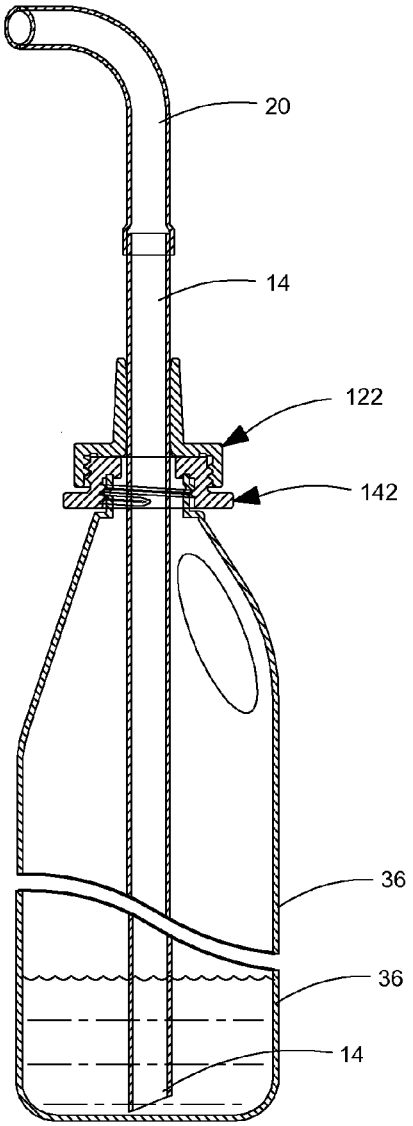
FIG. 27 is a sectional view of the embodiment depicted in FIGS. 20, 23 and 26, in combination with an original package lubricant bottle with a small throat.

FIG. 26 is a sectional view showing adapter 142 and cap 122 threaded together as an assembly and incorporating plastic extension tube 14, 126. FIG. 27 depicts cap adapter 142 and 122 threaded onto the smaller squeeze type, fluid bottle 36 as an assembly incorporating extension tube 14 extended into base of the bottle's fluid and adapter elbow 20.

Figure 28:
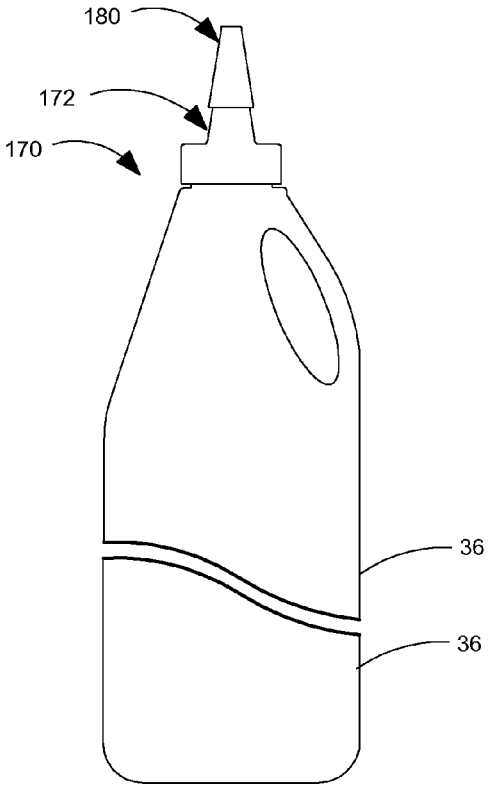
FIG. 28 is a side elevation view of a retail packaged squeeze type fluid bottle with a cap.
Figure 29:
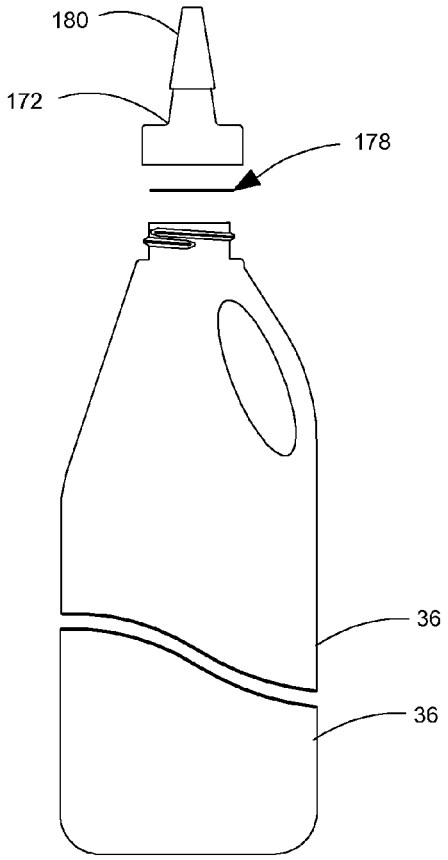
FIG. 29 is a side elevation view of a retail package squeeze type fluid bottle with spout cap and seal removed.
Figure 30:
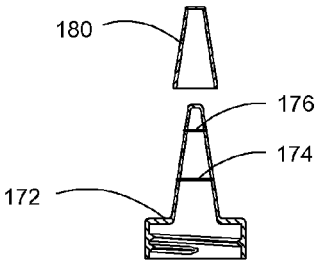
FIG. 30 is a side sectional view of a retail package squeeze type fluid bottle spout cap and spout tip.
Figure 31:
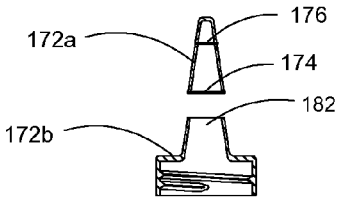
FIG. 31 is a side sectional view of a retail packaged squeeze type fluid modified bottle spout.
Figure 32:
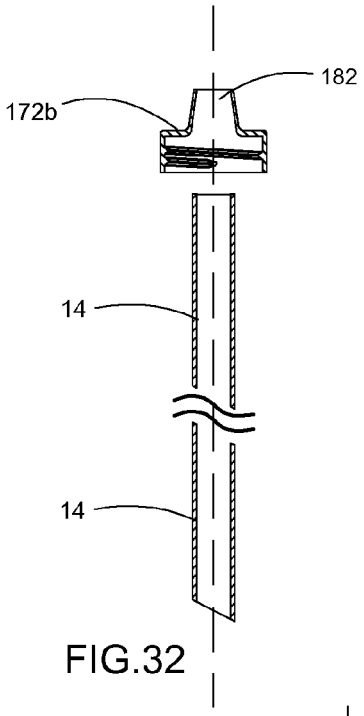
FIG. 32 is a sectional view of a retail packaged squeeze type fluid modified bottle spout cap and plastic extension tube.
Figure 33:
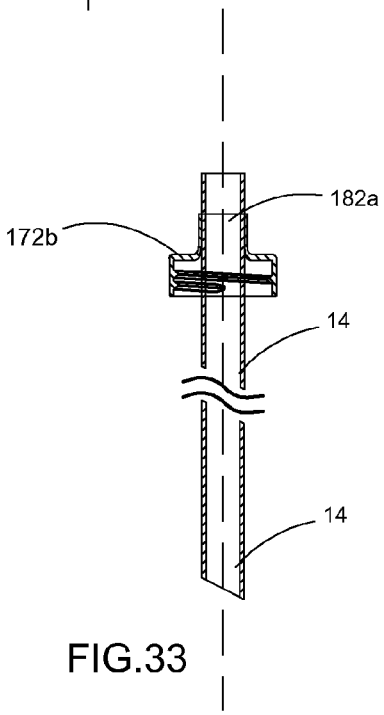
FIG. 33 is a sectional view of a retail packaged squeeze type fluid modified bottle spout cap in combination with a plastic extension tube.
Figure 34:
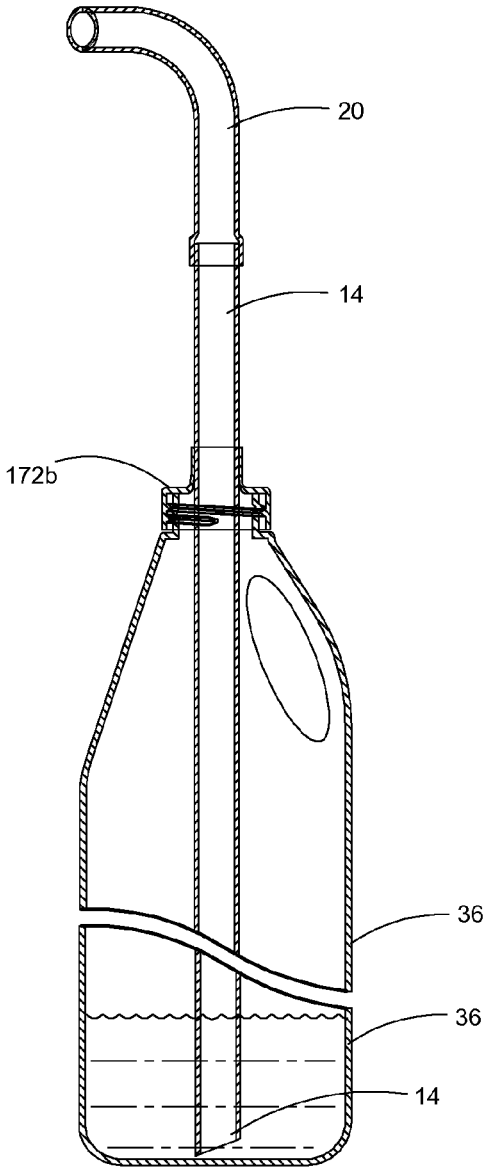
FIG. 34 is a sectional view of an example of an original package lubricant bottle with small throat, in combination with an adapter assembly as depicted in FIGS. 32 and 33.

FIG. 28 depicts an original factory package retail squeeze type fluid bottle that incorporates a tapered spout tip 180 that is presently available in the retail market as a complete assembly 170. Squeeze type fluid bottle 36 is provided with threaded tapered spout cap 172 includes a tip cap 180 the spout cap 172. FIG. 29 is step (1) of process and method of modifying. Removal of the thread spout cap 172 and removal of the factory gasket seal 178. FIG. 30 is step (2) of process and method of modifying the spout cap assembly. Removal of the tip cap 180 and removal from spout cap 172 of the spout tip 176 and barb ring 174 that retains the spout tip cap 180. FIG. 31 is step (3) of process and method of modifying the spout cap 172. Spout cap 172 is cut at the base of spout barb ring 174 and removal of top part 172*a* of spout top cap 172. The tapered throughbore 182 of modified spout cap 172 is referred as 172*b* in FIG. 31. FIG. 32 is step (4) of process and method of modifying the spout cap assembly. Modified spout 172*b* with tapered throughbore 182 is arranged alignment with plastic extension tube 14. FIG. 33 is step (5) of process and method of modifying the spout cap assembly Plastic extension tube 14 is inserted through the base opening of modified spout cap 172*b*. Pushing though cap 172*b* will expand the tapered throughbore of 182 and conform to the outside diameter of extension tube 14. This deforms the tapered throughbore 182 to be a tight cylindrical throughbore now referred 182*a*. This will create a liquid seal between 172*b* and plastic extension tube 14 with the deformed spout extension 182*a*. FIG. 34 is step (6) of process and method of modifying the spout cap assembly. FIG. 34 shows the modified spout cap 172*a* threaded onto the squeeze type fluid bottle 36 as an assembly incorporating extension tube 14 extended into the base of the bottle's fluid and adapter elbow 20.

Figure 4A:
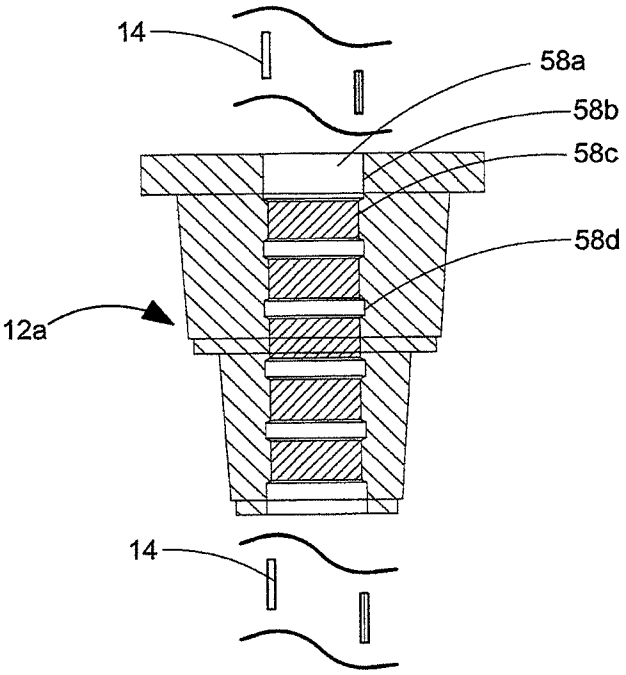
FIG. 1*a* is a perspective view of an adapter of the type depicted in FIG. 1 further depicting the construction of a bore passage through the adapter and FIG. 4*a* is a sectional view of the adapter of FIG. 1*a* taken along the line 4*a*-4*a*.
Figure 1A:
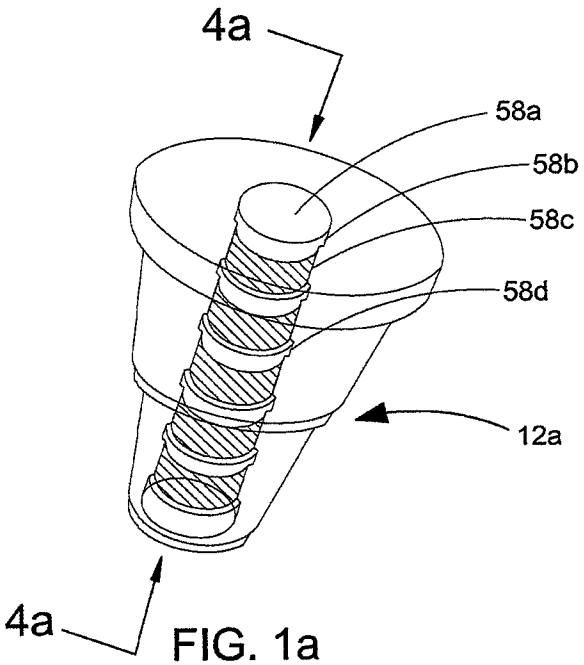

FIG. 1*a* depicts a modification, to the embodiment of FIG. 1, FIG. 4*a* is a cross sectional view of FIG. 1*a*. Specifically the embodiment of FIGS. 1*a* and 4*a* comprises a throughbore which is segmented into a series of alternating configurations. That is, the throughbore is divided into a top entry section of the form of a cylindrical passage 58*a* circular wall 58*b* that leads to a frusto-conical tapered section that guides a tube, for example, tube 14 into a reduced diameter conical section 58*c*. Alternating variable diameter cylindrical sections 58*c* and 58*d* extend through the length of the throughbore. This arrangement is designed to provide extra sealing capacity yet enhance the ability to insert an tube extension 14 into the throughbore.

Various embodiments of the invention have been disclosed directed to the general concept of providing a system or means for incorporating a plug, stopper or adapter as an element of a discharge mechanism for a squeeze bottle. The mechanisms include a configured plug or adapter, a series of modified cap constructions, a cap construction comprising multiple, separate cap components a single cap modified to cooperate with multiple diameter throat openings and modifications of the described assemblies. A feature of the various assemblies is that the assemblies may be component parts of a kit wherein the various plugs, stoppers, caps, extension tubes, elbow tubes and the like may be combined to provide a customized fluid discharge assembly component parts which may be assembled by a technician or a mechanic in a manner for performing a particular task with respect to lubrication and/or filling a reservoir or otherwise dispensing a fluid. The customized assembly may be coupled to a commercial squeezable container and utilized as an element of a manual pump assembly.

Though embodiments of the different cap adapters and extension tubes for squeeze type fluid bottles for dispensing liquid are described, the invention can be modified in both arrangement and detail. For example, the adapter cap may employ different cylindrical throughbore configurations. The inside diameter a multitude of extension tube sizes and tube adapters, and longer or shorter single tapered adapters designed to fit into the different sized and shaped the interior walls of the bottle throat openings may be adopted. These and other modifications and embodiments are thus within the scope of the invention and the protection afforded is limited in accordance with the scope of the following claims and equivalents.

What is claimed is:

1. A plug construction for a squeeze type fluid dispensing bottle having a bottle throat opening, said plug construction comprising:

a multiple frusto-conical stepped, tapered, flexible material plug, said plug sized to fit and seal a bottle throat opening, said plug including an elongate, unitary body, said body including (1) a longitudinal axis, (2) a lower end, and (3) an upper end spaced axially from the lower end, said body further including a substantially straight linear throughbore passage extending through the body and the ends of the body, said peripheral surface comprised of a series of separate, coaxial frusto-conical sections, each frusto-conical section including a lower face having a lower diameter located toward the lower end of the body, each frusto-conical section further including an upper diameter face having an upper diameter greater than the lower diameter of the lower face, the upper face diameter of each frusto-conical section less than the diameter of the opposed, adjacent frusto-conical section lower face, said frusto-conical sections lower face and upper face of adjacent frusto-conical sections separated by an intermediate, coaxial, rib member having a diameter intermediate the diameters of the separated faces of the adjacent frusto-conical sections.

2. The plug construction of claim 1 in combination with:

a removable hollow tube positioned through the plug throughbore passage, said tube capable of providing a fluid tube passageway from an interior of a bottle having said plug inserted into a bottle throat opening, said hollow tube including an inlet opening at an end and a dispensing port at an opposite end, said tube adapted to be slidably positionable and sealingly engaged in said throughbore passage for dispensing fluid contents from a squeeze bottle through the dispensing port by squeezing the bottle.

3. The combination of claim 2 wherein the tube comprises multiple sections.

4. The combination of claim 2 wherein the tube is sufficiently elongate to extend substantial to an inside base of a squeeze bottle container.

5. The construction of claim 1 wherein the throughbore passage comprises a series of alternating passage configurations.

6. The construction of claim 5 wherein the alternating passage configurations are cylindrical and include tube engaging sections sized to engage and seal a tube in the throughbore passage.

7. The construction of claim 6 including cylindrical sections having a guide entry section for guiding a tube into an adjacent tube engaging section sized to seal a tube in said throughbore passage.

8. The construction of claim 2 in combination with a squeeze bottle.

9. The combination of claim 4 in combination with a squeeze bottle.

10. The combination of claim 5 in combination with a squeeze bottle.

11. The combination of claim 6 in combination with a squeeze bottle.

12. The construction of claim 1 wherein said plug includes a frusto-conical section located at the lower end of the body with a coaxial rib member on the lower diameter face having a diameter less than the lower face diameter of said frusto-conical section located at the lower end of said body.

13. A plug construction for a squeeze type fluid dispensing bottle with a bottle throat opening, said plug construction comprising:

a multiple frusto-conical stepped, tapered, flexible material plug, said plug sized to fit and seal a bottle throat opening, said plug including an elongate, unitary body with a peripheral surface, a lower end, an upper end spaced from the lower end, a longitudinal axis between the lower end and the upper end, the lower end spaced axially from the upper end, said body further including a substantially linear throughbore passage extending through the body and the ends of the body, said peripheral surface comprised of a series of separate, co-axial frusto-conical sections, each frusto-conical section including a lower diameter face, said lower diameter face located toward the body lower end of the body, each frusto-conical section having an upper diameter face with an upper diameter greater than the diameter of the lower face diameter face and less than the diameter of the lower diameter face of the next adjacent frusto-conical section toward the upper end of the body, said peripheral surface comprised of said elastic material, said plug throughbore passage including a passage entry to a series of alternating (1) generally uniform shape lesser cross section throughbore passage sections and (2) throughbore passage sections having a greater uniform shape cross section, said smaller cross sections configured to receive and retain a tube inserted through the linear passage.

14. The plug construction of claim 13 wherein the alternating passage cross sections are generally cylindrical.

15. The construction of claim 14 wherein the greater throughbore passage cross sections include a tapered entry tube guide into a said alternate lesser diameter cylindrical throughbore passage section.

16. The plug construction of claim 13 including:

a removable hollow tube positioned through the plug throughbore passage, said tube capable of providing a fluid tube passageway from the interior of a bottle having said plug construction inserted into a bottle throat opening, said hollow tube including an inlet opening at an end and a dispensing port at an opposite end, said tube adapted to be slidably positionable and sealingly engaged in said throughbore passage for dispensing fluid contents from a squeeze bottle through the dispensing port by squeezing the bottle.

17. The plug construction of claim 16 wherein the tube comprises multiple sections.

18. The plug construction of claim 16 wherein the tube is sufficiently elongate to extend substantial to an inside base of a squeeze bottle container.

19. The plug construction of claim 16 in combination with a squeeze bottle container.

20. The plug construction of claim 14 in combination with a tube inserted in the linear passage.

21. The plug construction of claim 15 in combination with a tube inserted in the linear passage.

22. The plug construction of claim 18 in combination with a squeeze bottle container.

* * * * *